US006295733B1

(12) United States Patent
Wexler et al.

(10) Patent No.: US 6,295,733 B1
(45) **Date of Patent: *Oct. 2, 2001**

(54) CHANGEABLE COLOR SHAVING AID

(75) Inventors: Fred C. Wexler, Madison; Manuel Andrade, Milford, both of CT (US)

(73) Assignee: Warner-Lambert Company, Morris Plains, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/285,364

(22) Filed: Aug. 3, 1994

(51) Int. Cl.[7] ..... B26B 21/24
(52) U.S. Cl. ..... 30/41; 30/41.7; 30/538
(58) Field of Search ..... 30/41.7, 41, 538

(56) References Cited

U.S. PATENT DOCUMENTS

| | | | |
|---|---|---|---|
| 2,703,451 | 3/1955 | Hensel et al. | 30/351 |
| 2,750,664 | 6/1956 | Merlo | 30/34 |
| 3,302,230 | 2/1967 | Poppelman | 15/167 |
| 3,618,563 | 11/1971 | Singer | 116/133 |
| 3,879,844 | 4/1975 | Griffiths | 30/34 |

(List continued on next page.)

FOREIGN PATENT DOCUMENTS

| | | |
|---|---|---|
| 348627 | 1/1990 | (EP) . |
| 2024082 | 1/1980 | (GB) . |
| WO 98/38015 | 9/1988 | (WO) . |

(List continued on next page.)

OTHER PUBLICATIONS

Notice of Opposition to a European Patent (Pat. No. EP–B–773 855), with Exhibits D1–10, dated Feb. 12, 1999.
USPTO Corrected Filing Receipt U.S. application No. 08/269,495, filed Jul. 1, 1994, Copy of Application Entitled "Shaving System", (12 Pgs., Dwgs. 4 sheets, Power/Declaration, 2 pgs., M.M. Tseng.

(List continued on next page.)

*Primary Examiner*—M. Rachuba
(74) *Attorney, Agent, or Firm*—Fitzpatrick, Cella, Harper & Scinto

(57) ABSTRACT

The present invention features a disposable razor cartridge unit or disposable razor system having a shaving aid in the form of a comfort strip mounted on a razor head, wherein the shaving aid provides a sensory change over a period of time so that the user knows that the razor head should be replaced. In one embodiment, the strip is in the form of a single layer and comprises a polymer of a first color. A coloring agent of a second color is added such that the resulting color of the shaving aid is a third color when the strip is new. The first coloring agent gradually leaches from the strip due to exposure to water, abrasion during usage, or a combination of the two, such that after a certain number of uses the color of the strip changes from the third color to the first color of the polymer. Among other embodiments of the present invention are multi-layer strips in which the outer layer or layers contain shaving aid material having a coloring agent of a first color, while the inner layer contains non-water soluble material of a second color. In a still further embodiment, one or more coatings are placed on the shaving aid. In all of these embodiments, sensory indications are provided to the user via the removal of the coloring agent, the shaving aid material or the coating, so that the user is aware that the razor head should be replaced.

9 Claims, 3 Drawing Sheets

U.S. PATENT DOCUMENTS

| | | | | |
|---|---|---|---|---|
| 4,170,821 | * | 10/1979 | Booth | 83/14 |
| 4,268,958 | | 5/1981 | Hilbert | 30/34 |
| 4,562,644 | | 1/1986 | Hitchens | 30/41 |
| 4,850,106 | | 7/1989 | Braun . | |
| 4,875,287 | | 10/1989 | Creasy et al. | 30/34 |
| 5,061,106 | | 10/1991 | Kent | 401/268 |
| 5,062,209 | | 11/1991 | Rais | 30/41.7 |
| 5,113,585 | | 5/1992 | Rogers et al. | 30/41 |
| 5,119,557 | | 6/1992 | Kaiko | 30/41.7 |
| 5,340,581 | | 8/1994 | Tseng . | |
| 5,388,331 | * | 2/1995 | Siamak | 30/41.7 |
| 5,653,971 | | 8/1997 | Badin et al. | 424/73 |
| 5,915,791 | | 6/1999 | Yin et al. | 30/41 |

FOREIGN PATENT DOCUMENTS

| | | |
|---|---|---|
| WO 92/15198 | 9/1992 | (WO) . |
| WO 93/03649 | 3/1993 | (WO) . |
| WO 93/14911 | 8/1993 | (WO) . |
| 9316135 | 8/1995 | (WO) . |
| WO 95/20472 | 8/1995 | (WO) . |
| WO 96/01172 | 1/1996 | (WO) . |
| WO 97/35694 | 10/1997 | (WO) . |
| WO 97/44164 | 11/1997 | (WO) . |

OTHER PUBLICATIONS

Advertisement—"Finally, a Razor Worth Holding Onto" (1 pg.), McCall's, Sep. 1992.

Declaration of Michael J. Kwiecien, May 14, 1998, (3 pgs.).

Response to Opposition, with Exhibits D11–17, dated Jul. 21,1999.

Patentee's Comments on the Observations of the Opponent, dated Apr. 12, 2000, Annex 1, Annex 2, Annex 3 and Exhibits D22–D28.

"How a $4 Razor Ends Up Costing $300 Million", Business Week, 2 pgs.,Jan. 29, 1990.

New Oxford English dictionary definition of "certain".

Official Leter dated Apr. 18, 1997 re: 95923840.3–1260/US9507506.

U.S. application No. 08/624819, Yin et al., filed Mar. 1996.

"Sensor for Women" product literature (copyright 1992).

* cited by examiner

CHANGEABLE COLOR SHAVING AID

The present invention relates to shaving aids for razor heads and in particular to shaving aids which change color, either in whole or in part, after a certain period of usage.

BACKGROUND OF THE INVENTION

In order to provide for smoother shaves and to increase the comfort of the user, shaving aids in the form of comfort strips have been mounted on disposable razor heads and in disposable razor systems for many years. For example, U.S. Pat. No. 4,170,821, issued to Booth, discloses a solid water soluble shaving aid incorporated as a strip attached to a disposable razor blade cartridge. Razor heads having such comfort strips are currently marketed with the shaving aid being mixed with a thermoplastic polymer and have a uniform, unchanging color and texture.

Generally, individuals with sensitive skin are most likely to be users of razors containing shaving aids. Consequently, many products which are currently marketed with shaving aids contain materials such as aloe and are directed at the sensitive skin user. However, a drawback of currently available comfort strip-type shaving aids is that the strips gradually degrade and, after a certain number of uses, the shaving aid material contained in the strips is reduced to the point that the strips are not effective for the sensitive skin user. At this point a sensitive skin consumer should replace the razor blade cartridge to ensure the continued availability of shaving aid. However, absent a definite indication, many users do not realize when the cartridge should be replaced and consequently the quality of the shave suffers.

Various attempts have been made to create systems to indicate when the user should change the cartridge. Most of the previous systems require the user to manually interact with the razor by an act such as the turning of a knob or the breaking off of a tab. Such systems are inefficient in that most users are not careful to accurately perform the acts necessary to monitor their razor cartridge usage.

It would, therefore, be desirable to provide a disposable razor cartridge or a disposable razor system with a shaving aid which would automatically indicate to the user that the cartridge containing the shaving aid should be replaced. Such shaving aids would not require manual intervention and thus would be more accurate than presently known systems.

It would further be desirable to provide such a shaving aid in the form of a comfort strip which would change color after a certain number of uses to signal to the user that the cartridge should be replaced. The color change may take place either through selective solubility or through abrasion. Such a shaving aid would allow the user to obtain the most efficient cartridge use. It would be particularly desirable to provide a shaving aid which changes color coincidentally with the wear of the blade such that when the strip changes the blade is no longer delivering average optimum performance.

SUMMARY OF THE INVENTION

The present invention features a disposable razor cartridge unit or disposable razor system having a shaving aid in the form of a comfort strip mounted on a razor head, wherein the shaving aid changes color over a period of time so that the user knows that the razor head should be replaced. In one embodiment, the strip is in the form of a single layer and comprises a polymer of a first color. A coloring agent of a second color is added such that the resulting color of the shaving aid is a third color when the strip is new. The coloring agent gradually leaches from the strip due either to exposure to water, abrasion during usage, or a combination of both such that after a certain number of uses the color of the strip changes from the third color to the first color of the polymer or some intermediate color noticeably different to the consumer. Alternatively, the polymer may be colorless so that when the coloring agent leaches out the resulting strip is colorless.

A third embodiment of the present invention is a two-layer strip in which the upper layer contains water soluble or a combination of soluble and non-soluble shaving aid material of a first color, while the lower layer contains essentially non-water soluble material of a second color. Upon exposure to water during usage, the upper layer gradually deteriorates to the point where the second color of the lower layer becomes visible through the upper layer, thus indicating the need to change the razor head.

A further embodiment involves a three-layer strip, in which both of the outside layers are of an water soluble or a combination of soluble and non-soluble material of a first color and the center layer is of a non-water soluble material of a second color. Such a tri-layered strip would allow the strip to be attached to the razor cartridge during manufacture without concern for the orientation of the top and the bottom of the strip. A tri-layered strip would be particularly useful when the strip is manufactured by the process of extrusion.

A still further, and most preferred, embodiment comprises a shaving aid of a first color which is coated with a sectional portion of a second color. During shaving, the coated section wears away through solubility, abrasion, or a combination of the two, to indicate to the consumer that the cartridge should be replaced. The coating may consist of multiple layers, some of which layers may wear away during usage.

In a still further embodiment, different color water soluble and non-water soluble coloring agents are mixed so as to indicate a single color when the strip is new. The water soluble agent leaches from the strip upon exposure to water so that after a certain period of usage the strip changes color to that of the non-water soluble coloring agent.

DETAILED DESCRIPTION

The embodiments of the present invention are designed to provide a disposable razor or a disposable razor system having a shaving aid mounted on the razor head. As used herein, the term "razor head" is meant to include disposable cartridges designed for separate attachment to a razor handle, as well as the operative portion of a razor wherein the cutting portion is integrally formed with the handle portion. According to the present invention, shaving aids are disclosed which provide a sensory indication to the user that the razor head should be replaced.

Figure 1:
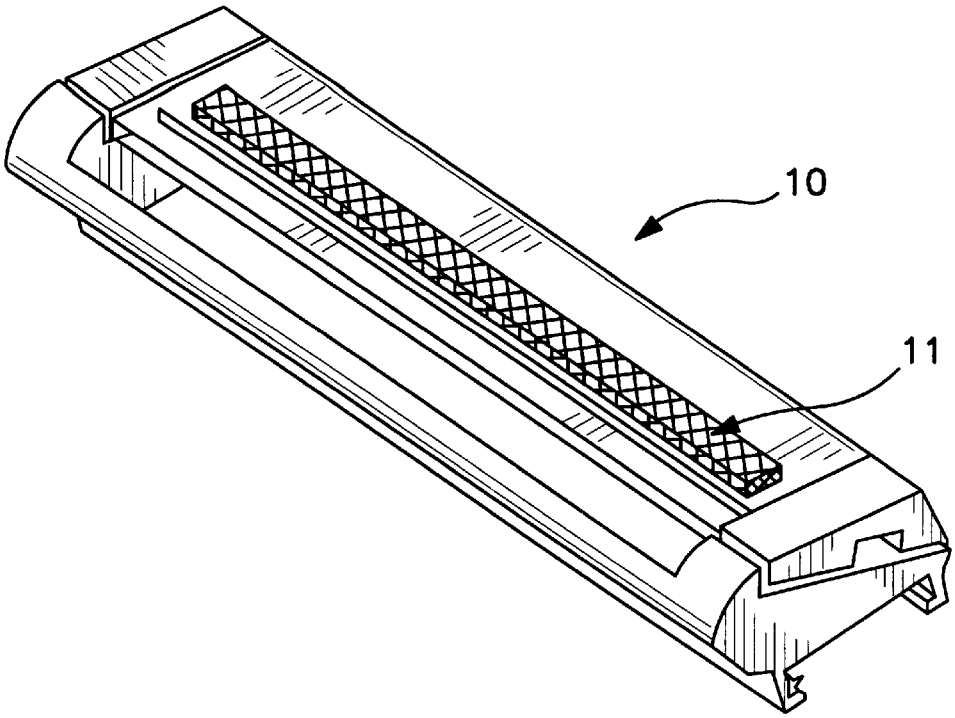
FIG. 1 is a perspective view of a razor head having a shaving aid in the form of a comfort strip.

FIG. 1 illustrates a razor head 10 incorporating a shaving aid 11 in the form of a comfort strip. Although the shaving aid is illustrated as a comfort strip located on the cap of the razor head above the blade, the shaving aid may be of any shape and may be located in any skin-engaging position on the razor. It is also possible for a shaving aid that relies on solubility to be located in a non-skin engaging surface and be effective. Further, one skilled in the art will appreciate that the razor head may be of various configurations, i.e., the razor may contain one or more blades and the razor head and handle may be integrally formed as in a disposable razor system.

Figure 2:
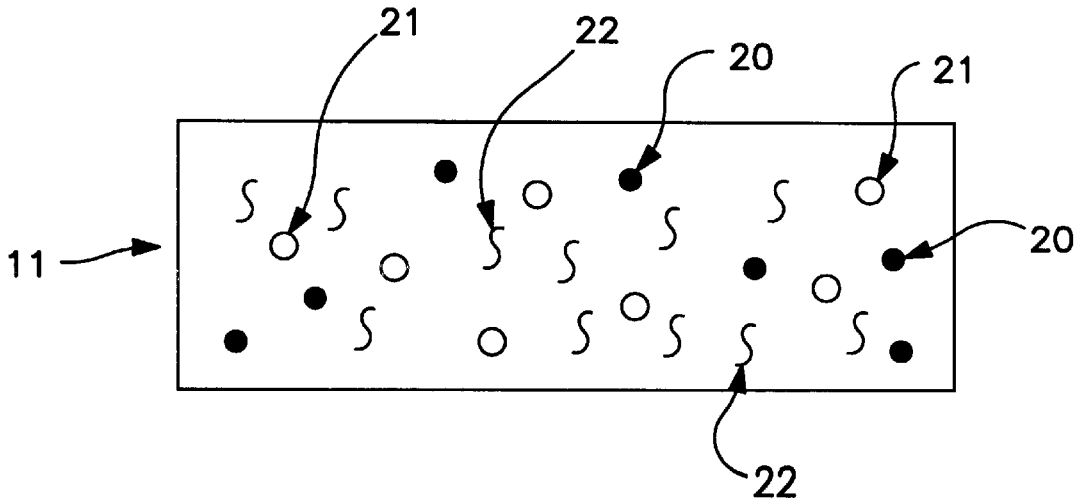
FIG. 2 is a micro-view of a shaving aid having aqueous and non-aqueous dye components.

FIG. 2 illustrates one embodiment of the shaving aid of the present invention. A water soluble coloring agent 20 of a first color and a non-water soluble coloring agent 21 of a second color are located in the shaving aid 11, along with thermoplastic material and a shaving aid material 22. Initially, when both coloring agents 20, 21 are present, the shaving aid 11 is a third color which is a combination of the colors of the two coloring agents. In a preferred embodiment, the solubility of the water soluble coloring agent is in accordance with the solubility of the shaving aid material so that the water soluble coloring agent leaches from the shaving aid at a similar rate due to exposure to water during usage as that of the shaving aid material.

During shaving, the shaving aid comes into contact with water and the water soluble coloring agent 20, along with the shaving aid material 22, leaches from the shaving aid 11. As the water soluble coloring agent 20 leaches from the shaving aid, the color of the shaving aid changes from the third color to the second color, i.e., the color of the non-water soluble coloring agent 21. When the shaving aid changes to the second color the user receives an automatic visual signal that the shaving aid of the razor head is depleted.

Common types of coloring agents which may be used are dyes, which are organic-based compounds, and pigments, which are either organic or inorganic. Typical inorganic pigments include titanium dioxide, zinc sulfide, iron oxides, chromates, cadmiums, chromium oxides, ultramarines, mixed metal oxides and carbon black. Common organic pigments include quinacridones, disazos and disazos condensates, monazo, monazos, naphthols, perylenes, benzimideazalones, isoindolinones, diarylides, quinophthalones, phthalocyanines, quinacridones, dioxazines, thioindigos, and tetrachloroisoindolinones and combinations thereof.

Common dyes which may be employed as the coloring agents include azos, perinones, quinolines, xantheren, azine and anthroquinones. The coloring agents, whether dyes or pigments, may be used in the form of a precolor, dry color, liquid color, or color concentrate. Specialty colorants, including pearlescent, metallic and fluorescent may be used separately or in addition to other coloring agents. In addition, other colorants of Food, Drug & Cosmetic or Drug & Cosmetic grade, such as nitro, azo, triphenymethane, xanthene, quinnoline, anthraquinone, indigoid, and pyrene classes of colorants, may be employed. The color of any of the coloring agents may be enhanced through the addition of certain color enhancing materials such as titanium oxide.

As an example, the shaving aid may contain a water soluble blue dye and a non-water soluble yellow dye. Before exposure to moisture the shaving aid would be a third color created by combining the two dye colors, or in this case green. Upon exposure to moisture, the water soluble blue dye leaches from the shaving aid, gradually removing the blue color component and changing the color of the shaving aid to yellow. When the color of the shaving aid in this case is yellow, the user would be alerted to replace the razor head.

In a preferred embodiment, the thermoplastic polymer of the shaving aid consists of a first color. A water soluble coloring agent of a second, different color is added to the shaving aid material. During use, the coloring agent leaches from the shaving aid and the color of the shaving aid changes to that of the thermoplastic polymer. In an alternative preferred embodiment, the thermoplastic polymer is colorless. A coloring agent is added to the colorless shaving aid, forming a shaving aid having the same color as that of the coloring agent. Upon usage, the coloring agent leaches away and the color of the shaving aid fades and eventually changes from the color of the coloring agent to colorless after usage.

Figure 3:
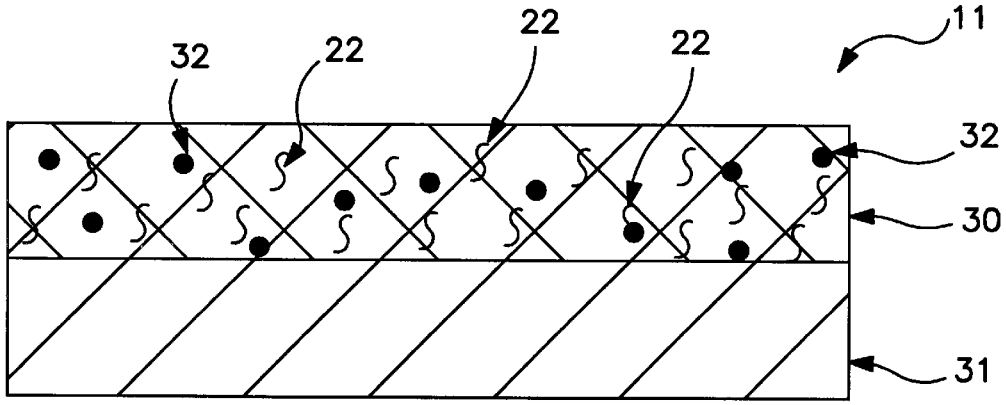
FIG. 3 is a cross-section view of a two-layer shaving aid.

FIG. 3 illustrates a cross-section of a further embodiment of the present invention. In this embodiment, the shaving aid 11 comprises two distinct layers. A lower layer 31 of thermoplastic material of a first color is mounted in a non-skin engaging position adjacent to the razor head and is non-water soluble. A water soluble or partially soluble upper layer 30 containing a water soluble coloring agent 32 of a second color is mounted in a skin-engaging position adjacent to the lower layer. The upper layer contains the shaving aid material 22. Thus, the shaving aid appears to the user as the second color prior to use and for a certain period of usage. Upon exposure to moisture during usage, the upper layer 30 deteriorates and uncovers the lower layer 31. Accordingly, the color of the shaving aid visible to the user changes from the second color of the upper layer to the first color of the lower layer or a discernible intermediate color and the user is thereby notified of the need to replace the razor head.

Figure 4:
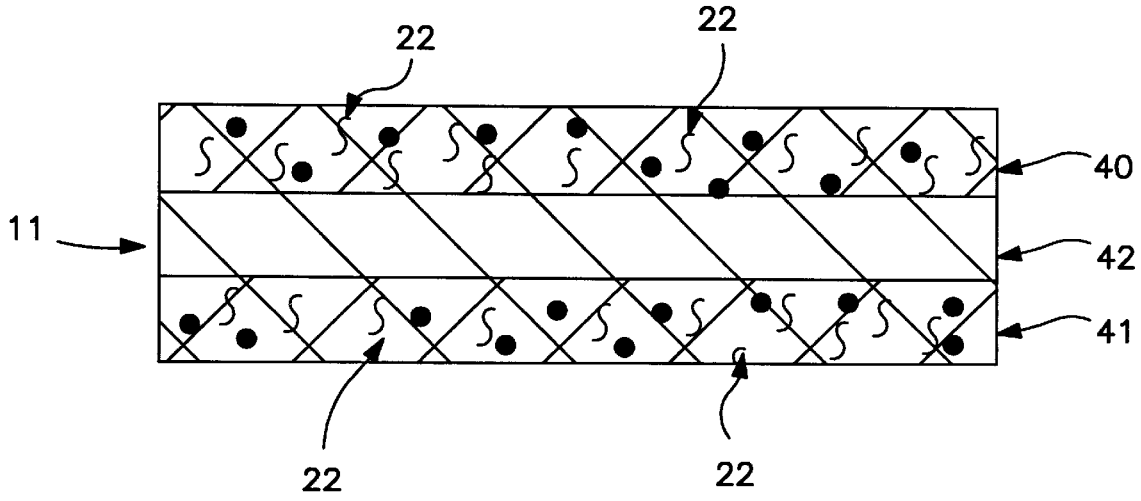
FIG. 4 is a cross-section view of a three-layer shaving aid.

FIG. 4 illustrates a cross section of a further preferred embodiment of the present invention which comprises a shaving aid having three distinct layers. Two water soluble or partially soluble outer layers 40, 41 of a first color consisting of water soluble coloring agent 44 and shaving aid material 22 coat a center layer 42 of a second color consisting of a non-water soluble thermoplastic material. The shaving aid is mounted on the razor head with either outer layer adjacent to the razor head. According to this embodiment, both outer layers contain shaving aid material, and consequently the shaving aid may be mounted without concern for orienting the skin-engaging side so that it is in the correct position.

Figure 5:
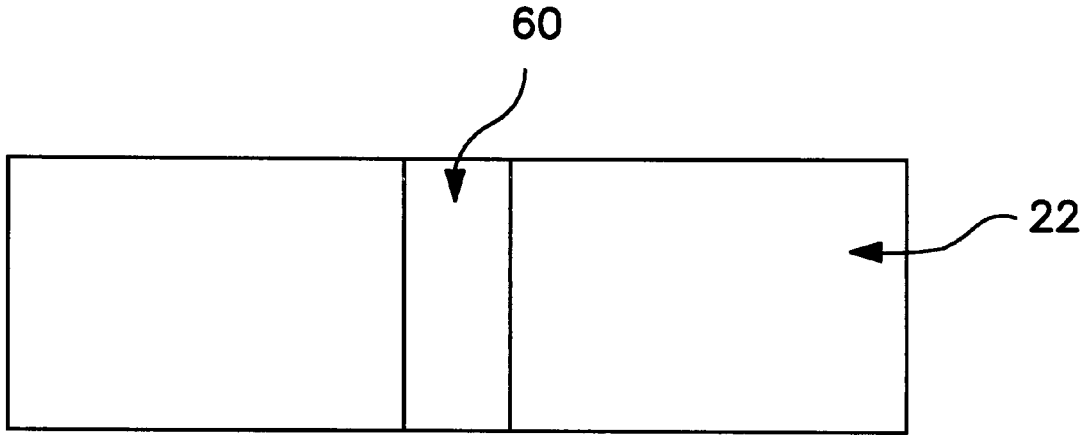
FIG. 5 is a perspective view of a shaving aid having a sectional portion coated with a material of a color different than that of the shaving aid.

FIG. 5 illustrates a still further and most preferred embodiment of the present invention. Water soluble or partially soluble coating 60 is disposed upon a section of the surface of shaving aid material 22. Coating 60 wears off of the shaving aid material through solubility, abrasion or a combination thereof. The disappearance of the coating is a signal to the consumer that the shaving aid should be replaced. Coating 60 comprises materials which are able to, at least initially, withstand the conditions, such as heat and humidity, which are encountered during shaving. Coating 60 may also consist of more than one layer, such that one or more layers wear off during usage and either a lower layer or the shaving aid material is ultimately exposed. Various materials which may be employed as a coating which would withstand those conditions include shellacs, glazes, paints, rosins, resins, sealants, gums, lacquers or combinations thereof.

While the coating illustrated in FIG. 5 is a single stripe in the middle of the shaving aid material, a plurality of sections of the shaving aid may be coated and the coating or coatings may comprise any desired shape or configuration. For example, multiple or single stripes, multiple or single spots, or multiple or single geometric shapes are all configurations which may be employed within the scope of the invention.

Exemplary materials which may be used as shaving aid material include one or various combinations of the following:

A. A lubricating agent for reducing the frictional forces between the razor head and the skin, e.g., a microencapsulated silicone oil.

B. An agent which reduces the drag between the razor parts and the skin, e.g., a polyethylene oxide in the approximate range of molecular weights between 100,000 and 5,000,000; a non-ionic polyacrylamide; and/or a natural polysaccharide derived from plant materials such as "guar gum".

C. An agent which modifies the chemical structure of the hair to allow the razor blade to pass through the whiskers very easily, e.g., a depilatory agent is one example.

D. A cleaning agent which allows whiskers and skin debris to be washed more easily from the razor parts during shaving, e.g., a silicone polyethylene oxide block copolymer and detergent such as sodium lauryl sulphate.

E. A medicinal agent for killing bacteria, or repairing skin damage and abrasions.

F. A cosmetic agent for softening, smoothing, conditioning or improving the skin.

G. A blood coagulant for the suppression of the bleeding that occurs from nicks and cuts.

H. An essential oil such as menthol.

The following examples are set forth to illustrate several formulations of the present invention. The examples are merely illustrative of formulations which fade in color to indicate the need to change the razor head and are not intended to limit the invention in any way.

EXAMPLE 1

39.7% pulverized, precolored (white using 10% titanium oxide) medium impact polystyrene 29.8% coagulant grade poly(ethylene oxide)

29.8% WSR N-750 grade poly(ethylene oxide)

0.7% green pigment

EXAMPLE 2

39.4% pulverized, precolored (white) medium impact polystyrene 29.6% coagulant grade poly(ethylene oxide)

29.6% WSR N-750 grade poly(ethylene oxide)

1.4% green pigment

EXAMPLE 3

38.6% pulverized, precolored (white) medium impact polystyrene 28.9% coagulant grade poly(ethylene oxide)

28.9% WSR N-750 grade poly(ethylene oxide)

3.6% green pigment

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

We claim:

1. In combination with a razor head having at least one blade, a shaving aid strip on the razor head in a skin engaging location, said shaving aid strip comprising:

a shaving aid material; and means for indicating a change in the amount of said shaving aid material, said means for indicating a change in the amount of shaving aid material comprising a coating which is disposed upon a section of the surface of said shaving aid material and which has a different color from that of the shaving aid material to form a visible stripe on the surface of the shaving aid material, said coating having wear characteristics related to the wear characteristics of said shaving aid material such that the disappearance of the coating from at least a portion of said shaving aid material through solubility, abrasion or a combination thereof provides a signal that the shaving aid strip should be replaced, irrespective of wear on said blade.

2. A razor head according to claim 1 wherein:

at least one of said shaving aid material and said coating contains a water soluble coloring agent.

3. A razor head according to claim 1 wherein:

said coating is in a skin engaging location.

4. A razor head according to claim 1 wherein:

said coating extends from one edge to an opposite edge of said shaving aid material.

5. A razor head according to claim 1 wherein:

at least one of said shaving aid material and said coating comprises an item selected from the group consisting of coloring agents, shellacs, glazes, resins, rosins, sealants, gums and lacquers.

6. A razor head according to claim 1 wherein:

said coating comprises one or more layers.

7. A razor head according to claim 2 wherein:

said coloring agent is at least one item selected from the group consisting of organic pigment, inorganic pigment and dye.

8. A razor head according to claim 2 wherein:

said coloring agent is at least one item selected from the group consisting of titanium dioxide, zinc sulfide, iron oxides, chromates, cadmiums, chromium oxides, ultramarines, mixed metal oxides, carbon black, quinacridones, diazos and diazos condensates, monazo, monazos, napthols, perylenes, benzimideazalones, isoindolinones, diarylkides, quinophtalones, phtalocyanines, quinacridones, dioxanes, thioindigos, tetrachloroisoindolinones, azos, perinones quinolines, xantheren, azine and anthroquinones, comprising a coating in the form of a colored stripe in the middle of the shaving aid material and disposed on top of a portion of the shaving aid material.

9. A method for using a razor head having at least one blade and a shaving aid strip in a skin engaging location, said strip comprising a shaving aid material and means for indicating a change in the amount of said shaving aid material, said means for indicating a change in the amount of shaving aid material comprising a coating which is disposed upon a section of the surface of said shaving aid material and which has a different color from that of the shaving aid material to form a visible stripe in the middle of the shaving aid material;

said method comprising the steps of:

observing the presence of a stripe on said razor head;

shaving with said razor head when said stripe has been observed; and discontinuing use of said razor head when said stripe is no longer visible.

* * * * *

UNITED STATES PATENT AND TRADEMARK OFFICE

CERTIFICATE OF CORRECTION

PATENT NO. : 6,295,733 B1
DATED : October 2, 2001
INVENTOR(S) : Fred Wexler et al.

It is certified that error appears in the above-identified patent and that said Letters Patent is hereby corrected as shown below:

Title page,
Item [56], References Cited, OTHER PUBLICATIONS, 6th reference
"Official Leter" should read -- Official Letter --.

Column 2,
Line 20, "an" should read -- a --.

Column 3,
Line 5, "non-skin engaging" should read -- non-skin-engaging --;
Line 39, "disazos" (second occurrence) should read -- disazo --;
Line 54, "quinnoline," should read -- quinoline, --.

Column 6,
Line 41, "diazos condensates," should read -- diazo condensates, --;
Line 42, "napthols," should read -- naphthols, --;
Line 43, "quinophtalones," should read -- quinophthalones, --;
Line 45, "perinones" should read -- perinones, --.

Signed and Sealed this

Twentieth Day of January, 2004

JON W. DUDAS
*Acting Director of the United States Patent and Trademark Office*